US005607206A

United States Patent [19]

Siddle et al.

[11] Patent Number: 5,607,206

[45] Date of Patent: Mar. 4, 1997

[54] CUTTING TOOL HOLDER RETENTION SYSTEM

[75] Inventors: David R. Siddle, Greensburg; Ted R. Massa, Latrobe, both of Pa.

[73] Assignee: Kennametal Inc., Latrobe, Pa.

[21] Appl. No.: 510,451

[22] Filed: Aug. 2, 1995

[51] Int. Cl.[6] ..... E21C 35/193

[52] U.S. Cl. ..... 299/102; 299/106

[58] Field of Search ..... 299/102, 103, 299/106, 108

[56] References Cited

U.S. PATENT DOCUMENTS

| | | | |
|---|---|---|---|
| 3,254,922 | 6/1966 | Krekeler | 299/109 |
| 3,749,449 | 7/1973 | Krekeler | 299/102 |
| 4,084,856 | 4/1978 | Emmerich et al. | 299/104 |
| 4,247,150 | 1/1981 | Wrulich et al. | 299/104 |
| 4,337,980 | 7/1982 | Krekeler | 299/102 |
| 4,542,943 | 9/1985 | Montgomery, Jr. | 299/102 |
| 4,621,871 | 11/1986 | Salani | 299/107 |
| 4,650,254 | 3/1987 | Wechner | 299/102 |
| 5,011,229 | 4/1991 | O'Neill et al. | 299/102 |
| 5,040,850 | 8/1991 | Komotzki | 299/106 |
| 5,067,775 | 11/1991 | D'Angelo | 299/104 |
| 5,370,448 | 12/1994 | Stewerf, Jr. | 299/107 |
| 5,378,050 | 1/1995 | Kammerer et al. | 299/102 |

FOREIGN PATENT DOCUMENTS

| | | | |
|---|---|---|---|
| 484777 | 12/1975 | Australia . | |
| 320615 | 1/1972 | U.S.S.R. | 299/102 |
| 2223045 | 3/1990 | United Kingdom | 299/102 |

OTHER PUBLICATIONS

"Presenting Two New Bit–Holding Systems To Hold Down Your Mining Costs" Kennametal Advertisement B91–158, published 1991.

"Kennametal Mining Products", Catalog B92–75(15)H2, published 1992.

"A Better Way to Improve Your Coal Production", Kennametal Brochure B92–58(5)E1, Published 1991.

*Primary Examiner*—David J. Bagnell

*Attorney, Agent, or Firm*—John J. Prizzi

[57] ABSTRACT

An excavation cutting tool holder retention system. The cutting tool holder retention system includes a cutting tool holder having a holder engagement surface and a support block having a tool holder bore into which the cutting tool holder is inserted. A pin having a pin engagement surface is movably mounted to the support block such that the pin engagement surface may be moved to engage the holder engagement surface. At least one of the holder and pin engagement surfaces defines an inclined surface such that when the pin engagement surface is moved to engage the holder engagement surface, the shank portion of the cutting tool holder will be drawn into the tool holder bore. In the preferred embodiment, at least one of the cutting tool holder and tool holder bore is tapered such that the cutting tool holder will be drawn and wedged into the tool holder bore of the support block when the pin engagement surface is moved to engage the holder engagement surface.

26 Claims, 4 Drawing Sheets

CUTTING TOOL HOLDER RETENTION SYSTEM

BACKGROUND

This invention relates to excavation cutting tools, and more particularly to a retention system for retaining an excavation cutting tool holder in a support block during use.

Excavation cutting tool assemblies for such applications as continuous mining or road milling typically comprise a cutting tool, sometimes referred to as a cutting bit, rotatably mounted within a support block. The support block in turn is mounted onto a drum or other body, typically by welding, which in turn is driven by a suitable power means. When a number of such support blocks carrying cutting tools are mounted onto a drum, and the drum is driven, the cutting tools will engage and break up the material which is sought to be mined or removed. The general operation of such a mining machine is well known in the art.

Because the support block is exposed, it is subject to wear and abuse and must be cut or torched off the drum and replaced when unusable. In order to prolong the life of the support block, a cutting tool holder, sometimes referred to as a cutting tool sleeve, bit holder, or bit sleeve, is sometimes employed. The cutting tool is rotatably or otherwise releasably mounted within the bit holder which in turn is mounted within the support block via some mechanical connection. This helps to protect the support block from abuse and wear, thus minimizing or eliminating the down time periods otherwise required for drum repair. The use of such bit holders is well known in the art. For example, U.S. Pat. No. 5,067,775 to D'Angelo discloses the use of such a bit holder which is referred to as a sleeve in that patent.

It is well known that such cutting tools and cutting tool holders are subjected to considerable stresses during mining or other operations. Accordingly, it is desirable that the cutting tool holder be mounted to the support block in such a manner as to minimize movement of the cutting bit holder in order to maximize the life of the cutting tool. It is also important that the mounting between the cutting tool holder and the support block be resistant to vibratory loosening which could likewise lead to premature cutting tool wear and failure. Various methods have been proposed or used in the past to mount a cutting tool sleeve within a support block in an attempt to minimize cutting tool holder movement or loosening, while maximizing cutting tool life.

For example, U.S. Pat. No. 3,749,449 to Krekeler discloses a support block having two upstanding members or bifurcations which define therebetween a channel into which fits a tool holder. A pin passes through the support block and the cutting tool holder and releasably secures the tool holder to the support block. The Krekeler patent relies on cooperation between the bottom surface of the cutting tool holder and an upper surface of the support block, at the bottom of the channel, to resist forces tending to pivot the cutting tool holder about the pin. In other words, the Krekeler patent relies upon a close tolerance fit to minimize rotational movement of the cutting tool and cutting tool holder about the pin during use. Otherwise, movement of the cutting tool holder in the support block will cause unnecessary wear to the cutting tool, the cutting tool holder, and the support block.

Alternatively, U.S. Pat. No. 4,650,254 to Wechner discloses the use of two bolts to connect a cutting tool holder to a block. The two bolts pass horizontally through the rear surface of the support block and through the shank portion of the cutting tool holder. Such a connection may be subject to vibratory loosening.

SUMMARY

An object of the present invention is to provide an improved excavation cutting tool holder retention system which allows a cutting tool holder to be securely fastened to a support block in such a manner as to minimize or eliminate any movement or loosening of the cutting holder within the support block.

In carrying out the above objects, and other objects and features of the present invention, an improved excavation cutting tool holder retention system is provided. The improved excavation cutting tool holder retention system comprises a cutting tool holder having a holder engagement surface and a support block having a tool holder bore into which the cutting tool holder is inserted. A pin having a pin engagement surface is movably mounted to the support block such that the pin engagement surface may be moved to engage the holder engagement surface. At least one of the holder and pin engagement surfaces defines an inclined surface such that when the pin engagement surface is moved to engage the holder engagement surface the shank portion of the cutting tool holder will be drawn into the tool holder bore.

In a preferred embodiment, at least one of the cutting tool holder and tool holder bore is tapered such that the cutting tool holder will be drawn and wedged into the tool holder bore of the support block when the pin engagement surface is moved to engage the holder engagement surface.

In a more preferred embodiment, the tool holder has a holder shoulder and the support block has a seating shoulder region adjacent the tool holder bore. When the cutting tool holder is drawn into the tool holder bore as described, the holder shoulder will abut the seating shoulder region.

The present invention also includes an improved cutting tool holder for use with a support block having a cutting tool holder bore into which the cutting tool holder is inserted and a pin having a pin engagement surface, the pin being movably mounted to the support block. The improved cutting tool holder comprises an outer wear region and a shank portion. The shank portion has a holder engagement surface which engages the pin engagement surface. At least one of the holder and pin engagement surfaces defines an inclined surface such that when the pin engagement surface is moved to engage the holder engagement surface the shank portion will be drawn into the tool holder bore of the support block.

The advantages resulting from this invention are numerous. For example, by having one of the holder and pin engagement surfaces defining an inclined surface, the cutting tool holder will be drawn into an especially tight relationship with the tool holder bore. This tight fit is especially secure if one or both of the shank portion or tool holder bore is tapered so that the shank portion of the cutting tool is wedged into the tool holder bore when the components are engaged by utilizing the pin. The security of the fit is also increased if the tool holder has a holder shoulder which abuts a seating shoulder region of the support block when the cutting tool holder is drawn into the tool holder bore. Another advantage of this present invention is that the tool holder bore of the support block may have a configuration so as to completely surround and provide multidirectional support to the cutting tool holder. As a further advantage, when the tool holder is worn, it is easily removed and changed by simply loosening the pin.

Further objects and advantages of this invention will be apparent from the following description, reference being had to the accompanying drawings wherein preferred embodiments of the present invention are clearly shown.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

DETAILED DESCRIPTION

Figure 1:
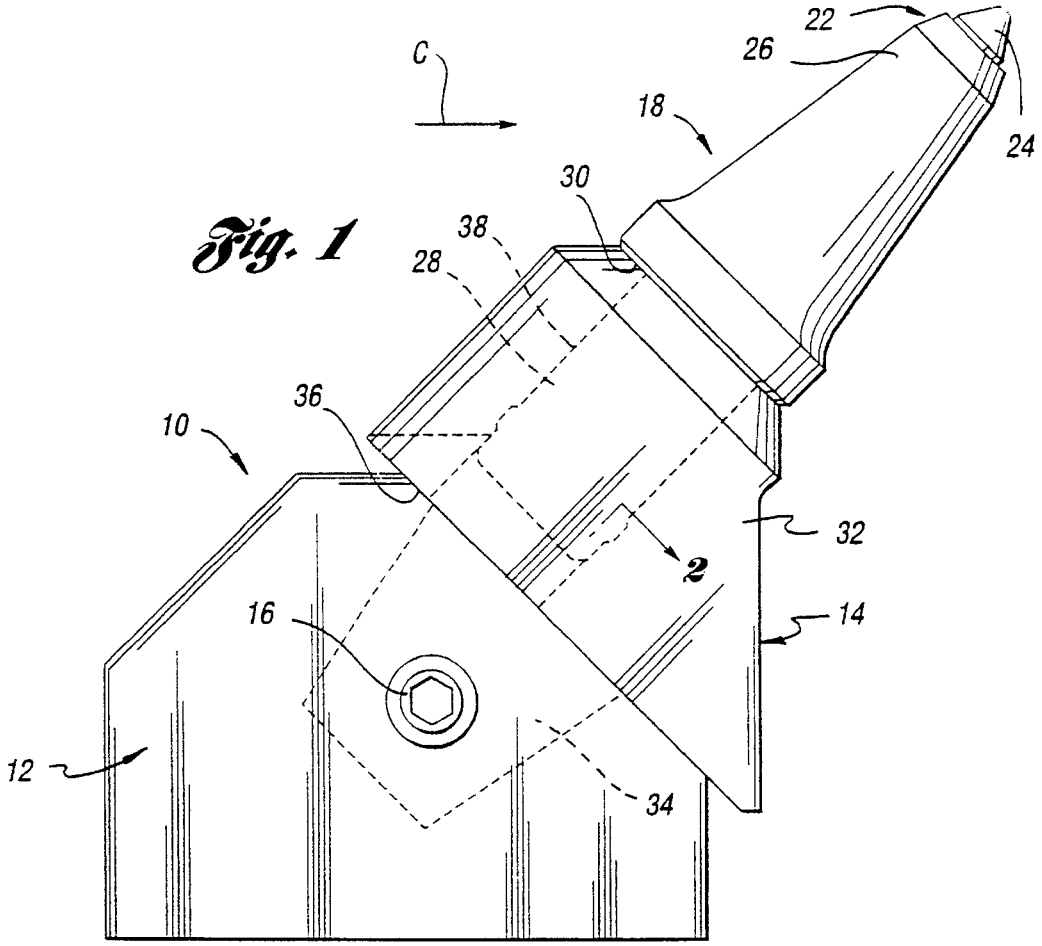
FIG. 1 is a side view of a support block, cutting tool sleeve, and cutting tool showing one embodiment of the invention.
Figure 2:
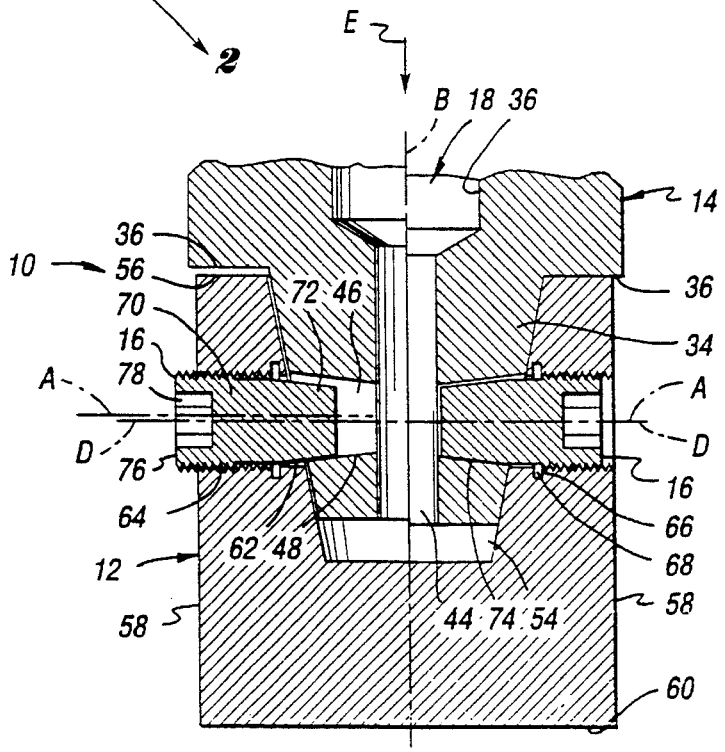
FIG. 2 is a sectional view taken along the plane indicated by line 2—2 in FIG. 1, the left-half showing the invention in the loose condition and the right half showing the tightened condition.

One embodiment of the cutting tool holder retention system 10 is shown in FIGS. 1 and 2. The cutting tool retention system 10 includes a support block 12 and a cutting tool holder 14 mated to the support block 12 via pins 16. In the embodiment shown, a cutting tool 18 may be rotatably and releasably mounted within the cutting tool holder 14. However, the scope of this invention would cover cutting tool holder retention systems in which the cutting tool is non-rotatably mounted.

In use, such support blocks 12 can be distributed over and fastened to, such as by welding, the circumference and length of a drum or other body (not shown) according to any desired pattern. The drum or other body may be driven by any conventional and suitable power means to cause the cutting tools 18 to engage and break up material that they are applied to. Such applications are well known in the art, and will not be described further here.

The cutting tool 18 typically has an elongated body. The cutting end 22 of the cutting tool 18 typically comprises a hard cutting insert 24 mounted onto a generally conical outer region 26. This hard cutting insert 24 may be made from cemented tungsten carbide or any other suitable material. The hard cutting insert 24 is generally mounted at the end of the conical outer region 26 where the cutting insert 24 may be brazed or otherwise suitably fastened into place. The cutting tool 18 also includes a tool shank 28 adjoining a shoulder 30 of the conical outer region 26. Because such cutting tools are generally known in the art, they need not be described in further detail here.

Cutting tool holders may have a variety of configurations. The cutting tool holder 14 shown in this embodiment has an outer wear region 32 and a shank portion 34 joined at a holder shoulder 36. The cutting tool holder 14 defines a tool bore 38 in which the cutting tool 18 may be rotatably or otherwise mounted. Such rotatable or non-rotatable mountings are well known in the art, and will not be described in further detail here.

While the shank portion 34 of the cutting tool holder 14 may have a variety of configurations, the shank portion 34 as shown is tapered. The shank portion 34 may be made of solid material, or as shown here, may have a cavity such as a vertical bore 44. The shank portion 34 also has a holder engagement recess which in this embodiment comprises transverse pin bores 46 which are aligned along the axis designated "A" and which intersect the center axis "B" of the shank portion 34. The transverse pin bores 46 are tapered. The holder engagement recess has a holder engagement surface 48 which in the embodiment shown is the lower inclined surface of the tapered transverse pin bores 46.

The support block 12 typically has a tool holder bore 54 surrounded by a seating shoulder region 56. The tool holder bore 54 in this preferred embodiment is tapered so as to match the taper of the shank portion 34 of the cutting tool holder 14. It has been found preferable that the maximum total included taper angle be approximately 16°.

The support block 12 also has a side surface 58 and a base 60 which may be mounted to a drum or other body (not shown) by way of welding or any other suitable method.

The tool holder bore 54, and accordingly the cutting tool holder 14 and the cutting tool 18, may be pitched in the direction of travel of the cutting tool 18, designated as direction "C" in FIG. 1.

For the purpose of this invention, the support block 12 has block pin bores 62, which are transversely aligned along the axis designated "D" and which intersect the center axis "B" of the tool holder bore 54 in a perpendicular relationship.

In the embodiment shown, the block pin bores 62 have a block threaded portion 64 extending from the side surface 58 to the tool holder bore 54. At the end of the threaded portion, an annular groove 66 may optionally be provided in which an O-ring 68 may be housed.

The pins 16 are movably mounted to the support block 12. In this embodiment of the invention, the pins 16 are movably mounted via a block engagement portion 70 which is threaded. The threaded block engagement portion 70 of the pin 16 is designed to threadably engage the threaded portion 64 of the block pin bores 62 of the support block 12. The pins 16 also have a pin engagement surface 72 which in this embodiment is tapered such as to provide an inclined surface 74 to engage the holder engagement surface 48 of the holder engagement recess 46.

The pins 16 also have a tightening end 76. The tightening end 76 preferably has a configuration, such as a non-circular shape, a protrusion, or a receiving aperture, by which a tool may be used to tighten the pins 16 in the block pin bores 62 as will be set forth. In the embodiment shown, the configuration comprises a hexagonal receiving aperture 78 designed to receive an allen wrench.

While the pins 16 may be made of any suitable material, an alloy steel, such as SAE 4140 or SAE 4340, is preferred.

While two pins 16 are shown as being used in the embodiment depicted, one or more pins may be used. No matter what number of pins are used, the axes of the transverse pin bores 46, and correspondingly the block pin bores 62, need not intersect the tool bore 38 in a perpendicular relationship. Instead, the transverse and block pin bores may be inclined at an angle to the tool bore 38, preferably downwardly from the block surface 58 to the center axis "E" of the tool holder 14 at an angle between 70° and 90°. Furthermore, if two or more pins are used, the axes of the transverse pin bores, and correspondingly the block pin bores, need not be transversely aligned, nor is it required that they intersect each other or intersect axis B.

To use the embodiment of this invention shown in FIGS. 1 and 2, the holder shank portion 34 of the cutting tool holder 14 is inserted into the tool holder bore 54 of the support block 12 such that the transverse pin bores 46 of the cutting tool holder 14 and the block pin bores 62 of the support block 12 are roughly aligned.

The pins 16 are then inserted into the support block pin bores 62. At this point, the transverse pin bores 46 and the block pin bores 62 are still roughly aligned as illustrated by the axes "A" and "D" shown on the left half of FIG. 2. At this point, there will also preferably be a small gap between the holder shoulder 36 and the seating shoulder region 56 of the support block 12, such as shown on the left half of FIG. 2.

The pins 16 are then moved such that the inclined surface 74 of the pin engagement surface 72 will engage the holder engagement surface 48 of the cutting tool holder 14. This movement of the pins 16 is accomplished via the tightening end 76 of the pin 16 which is engaged, with a tool (not shown) or other means, so as to threadably engage the threaded block engagement portion 74 of the pin 16 in the threaded portion 64 of the block pin bore 62. Nylok® nylon based frictional material manufactured by Nylok Fastener Corporation, or any other suitable material or adhesive, may be employed to help prevent the pin 16 from backing out of the block pin bore 62 during use.

Because at least one, in this case both, of the holder engagement surface 48 and the pin engagement surface 72 defines an inclined surface, the holder shank 34 of the cutting tool holder 14 will be forcibly wedged downward in the direction marked "E" into a tight fitting relationship with the tool holder bore 54 of the support block 12 until the holder shoulder 36 abuts the seating shoulder region 56. At this point, in the embodiment shown, the axis "A" of the transverse pin bores 46 and the axis "D" of the block pin bores 62 will be substantially coincident as shown on the right half of FIG. 2. In order to accomplish this result, it is preferred that the holder engagement surface 48 and pin engagement surface 72 each have a maximum total included angle of approximately 16°. The resulting fit, as shown on the right side of FIG. 2, is especially secure because the holder shank portion 34 and the tool holder bore 54 are matingly tapered.

Accordingly, the resulting tight fit, and the holder shoulder 36 abutting the block seating shoulder region 56, advantageously prevents the cutting tool holder from rotating about the axis "D" of the pins 16. The wedging effect between the holder engagement surface 48 and pin engagement surface 72 in conjunction with the wedging between the holder shank 34 and the tool holder bore 54 will also minimize loosening due to vibration. As a further advantage, when the tool holder is worn, it is easily removed and changed by simply loosening the pins 16.

Figure 3:
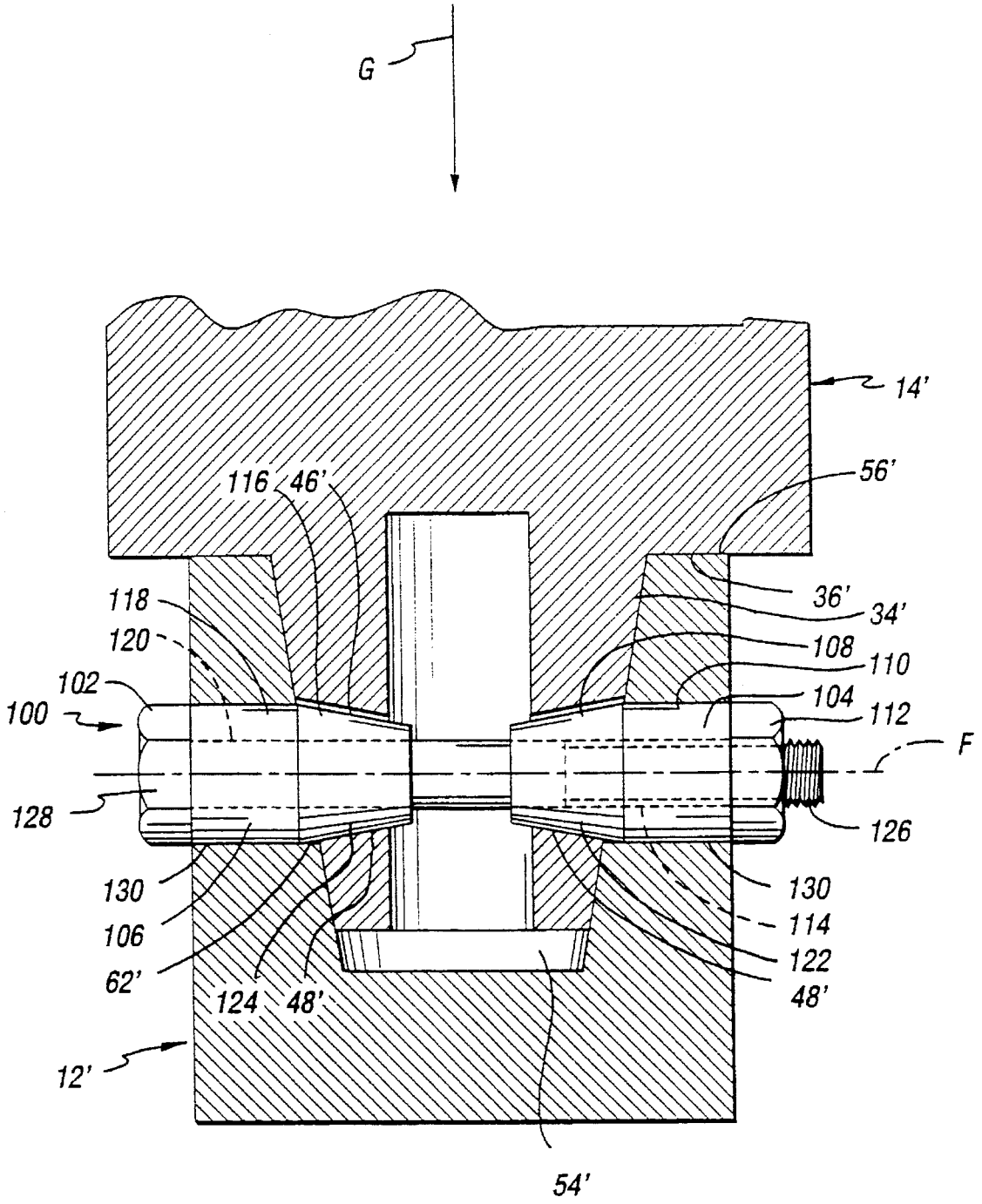
FIG. 3 is a sectional view showing an alternative pin.

An alternative embodiment of this invention is shown in FIG. 3 which is a sectional view similar to FIG. 2. This embodiment is very similar to the cutting tool holder retention system 10 shown in FIGS. 1 and 2. Accordingly, the same components have been referenced using the same reference characters followed by an apostrophe. The main difference is the pin 100 which in this embodiment comprises a screw or threaded bolt 102, a jam member 104, and a cone member 106. The jam member 104 has cone end 108, a cylindrical section 110, a tool end 112, and a threaded throughbore 114. The tool end 112 preferably has a configuration, such as a non-circular shape, a protrusion, or a receiving aperture, by which a tool may be used to retain the jam member 104 in a stationary position while the screw or threaded bolt 102 is being tightened. In the embodiment shown, the tool end 112 has a hexagonal nut configuration designed to be engaged by a wrench.

The cone member 106 has a cone end 116, a cylindrical end 118, and a smooth throughbore 120. The exterior surface of the cone ends 108 and 116 define pin engagement surfaces 122 and 124 respectively which, as a result of the taper of the cone ends 108 and 116, provide inclined surfaces to engage the holder engagement surfaces 48' of the pin bores 46'. It is preferred that the pin engagement surfaces 122 and 124, and the pin engagement surfaces 48', have a maximum total included angle of approximately 16°.

The screw or threaded bolt 102 has a threaded shaft 126 and a head 128 preferably with a configuration, such as a non-circular shape, a protrusion, or a receiving aperture, by which a tool may be used to tighten the screw or threaded bolt 102 in relation to the jam member 104. In the embodiment shown, the configuration of the head 128 is hexagonal such as to be engaged by a suitable wrench.

This alternative embodiment is also different from the embodiment disclosed in FIGS. 1 and 2 in that the block 12' of this embodiment has a block pin bore 130 which is not threaded, but instead is smooth-walled so as to slidably receive the cylindrical section 110 of the jam member 104 and the cylindrical end 118 of the cone member 106.

The use of this embodiment is similar to the use of the embodiment shown in FIGS. 1 and 2. First, the holder shank portion 34' of the cutting tool holder 14' is inserted into the tool holder bore 54' of the support block 12' such that the transverse pin bores 46' and the block pin bores 130 are roughly aligned. At this point, there will preferably be a small gap between the holder shoulder 36' and the seating shoulder region 56' of the support block 12'. The screw or threaded bolt 102, with the cone member 106 already slid onto the shaft 126 is then inserted through the support block pin bores 62' and the transverse pin bores 46'. The jam member 104 is then threadably tightened onto the shaft 126 such that the pin engagement surfaces 122 and 124 will engage the holder engagement surface 48' of the cutting tool holder 14'. Because at least one, in this case both, of the holder engagement surfaces 48' and the pin engagement surfaces 122 and 124 defines an inclined surface, the shank portion 34' of the cutting tool holder 14' will be wedged downward in the direction marked "G" into a tight fitting relationship with the main bore 54' of the support block 12' until the holder shoulder 36' abuts the seating shoulder region 56' as shown in FIG. 3. In order to accomplish this result, it is preferred that the holder engagement surface 48' and pin engagement surfaces 122 and 124 have a maximum total included angle of approximately 16°.

Figure 4:
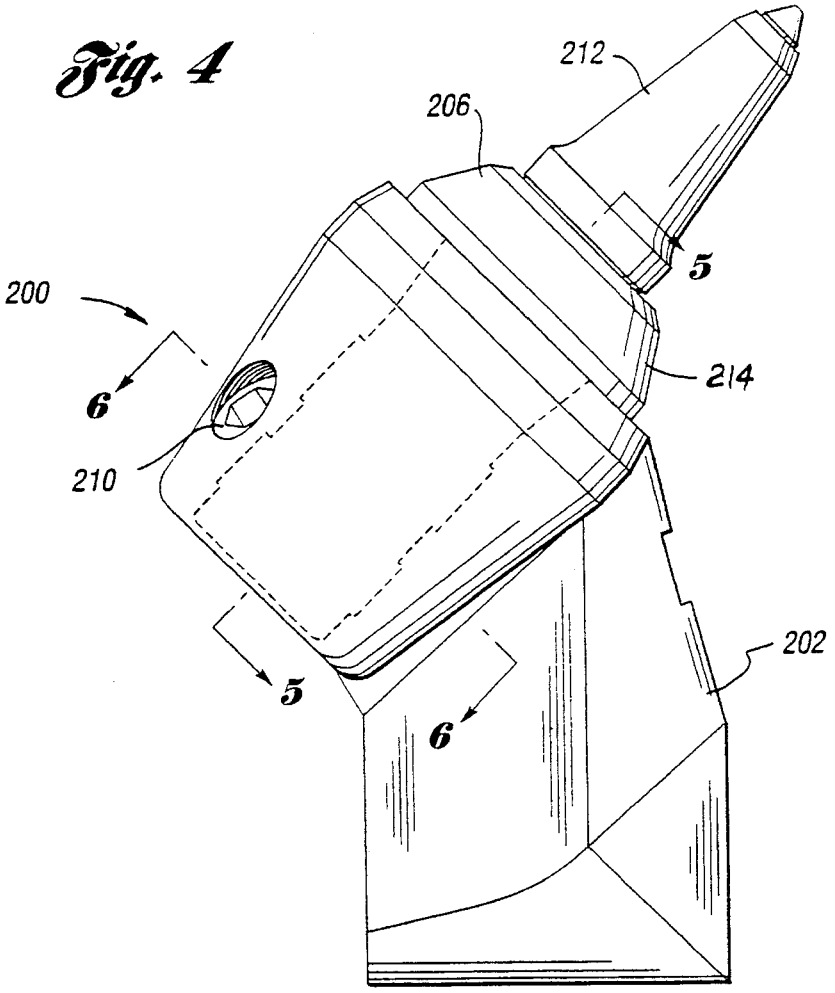
FIG. 4 is a side view of a support block, cutting tool sleeve, and cutting tool showing an alternative embodiment of the invention.
Figure 5:
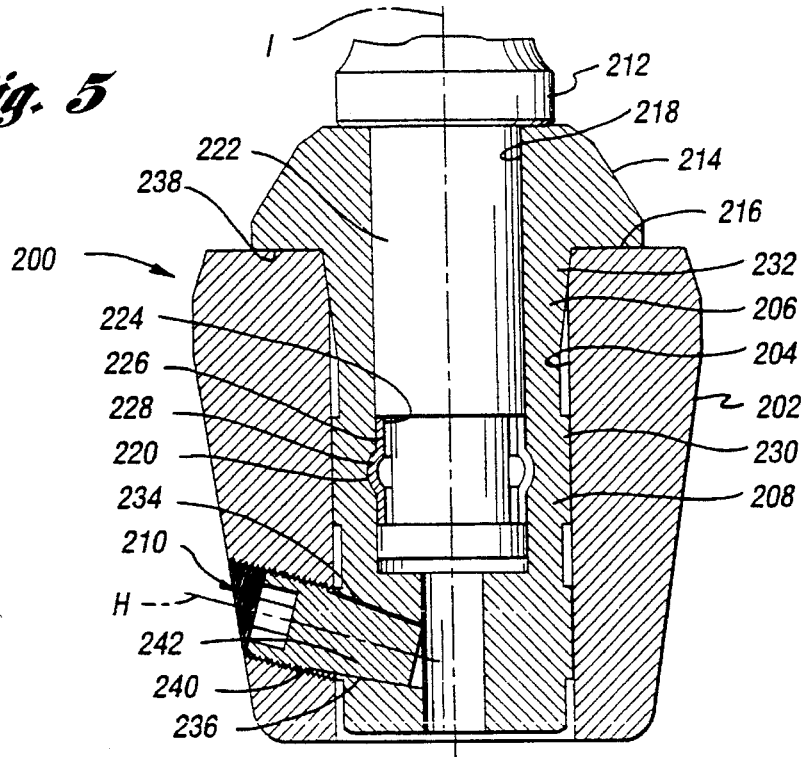
FIG. 5 is a sectional view taken along the plane indicated by line 5—5 in FIG. 4.
Figure 6:
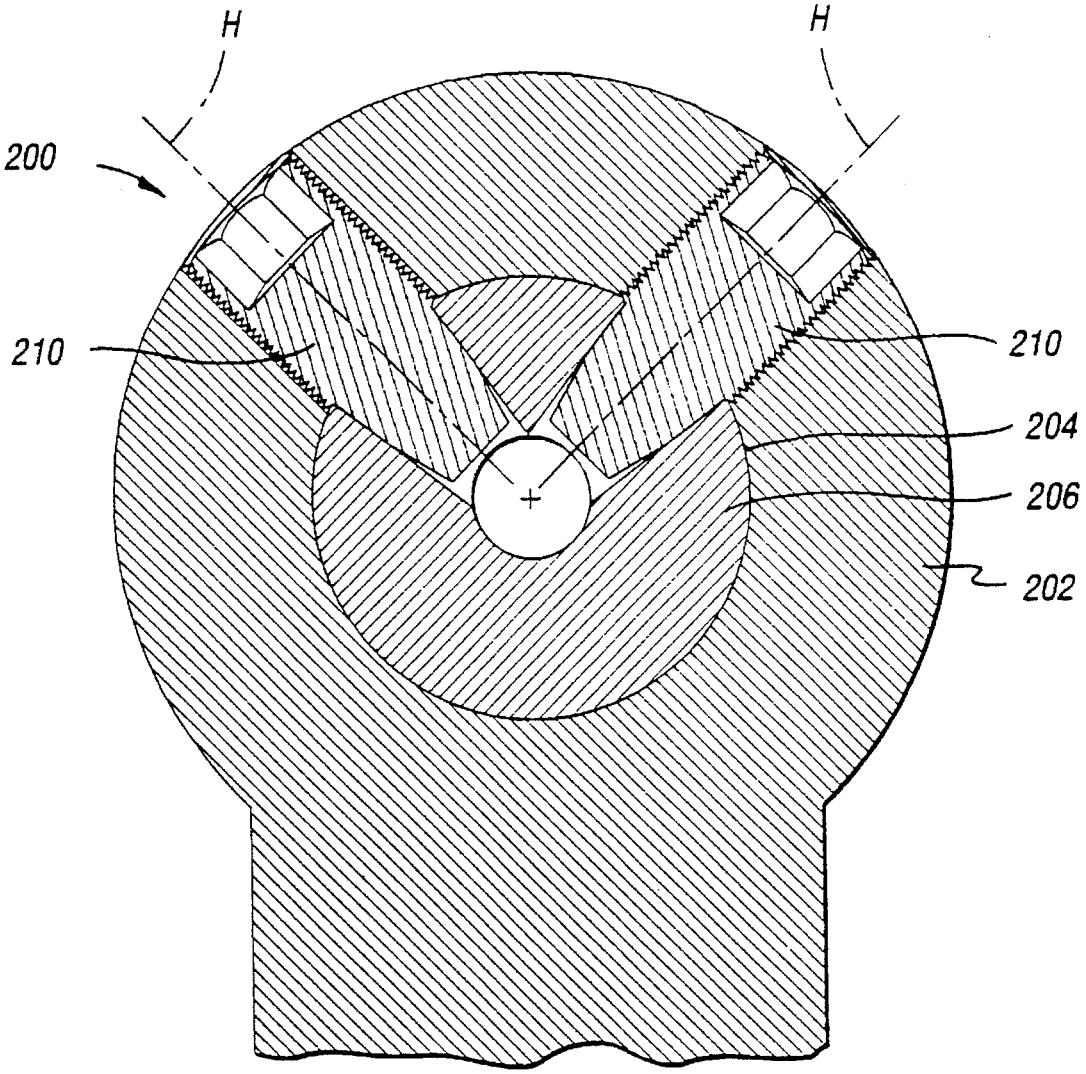
FIG. 6 is a sectional view taken along the plane indicated by line 6—6 in FIG. 4.

Another alternative embodiment of the cutting tool holder retention system 200 is shown in FIGS. 4, 5 and 6. This cutting tool holder retention system 200 includes a support block 202 having a main bore 204, a cutting tool holder 206 having a holder shank portion 208, and pins 210. A cutting tool 212 may be rotatably mounted within the cutting tool holder 206. While the geometrical configuration of the support block 202 and the cutting tool holder 206 has been changed, this embodiment is similar to the embodiments shown in FIGS. 1 and 2 with the exception that the two pins 210 have axes "H" which need not be aligned and which need not be perpendicular to the axis "I" of the shank portion 208 of the cutting tool holder 206. Instead, the axes "H" of the two pins 210 are inclined at an angle as best shown in FIG. 5.

The cutting tool holder 206 in this embodiment is generally symmetrical about the axis "I" and includes an outer wear region 214 and a holder shoulder 216. The cutting tool holder 206 defines a tool bore 218 in which the cutting tool 212 may be rotatably and releasably mounted. As shown in this embodiment, the tool bore 218 defines an annular keeper groove 220. The cutting tool 212 shown in this embodiment has a tool shank 222 defining an annular shank groove 224 adapted for receiving a split keeper ring 226 having projections 228. The tool shank 222 is rotatably mounted within the tool bore 218 via the projections 228 of the split keeper ring 226 which fit within the annular keeper groove 220 of the tool bore 218. Such a mounting is described in U.S. Pat. No. 3,519,309 to Engle et al. and is generally known in the art.

Alternatively, the cutting tool 212 could be rotatably mounted within the tool bore 218 via the mounting disclosed in a copending application entitled "Cutting Tool Retention System," filed on the same date as this application, having Attorney Docket No. K-1269, having U.S. Ser. No. 08/510,160, and naming Ted Richard Massa as the inventor.

The shank portion 208 of the cutting tool holder 206 of this embodiment comprises a generally cylindrical portion 230 and an upper tapered portion 232 adjacent the shoulder 216. The shank portion 208 also has a holder engagement recess which in this embodiment comprises inclined holder pin bores 234, the axes of which intersect the center axis "I" of the shank portion 208. The holder engagement recess has a holder engagement surface 236 which in the embodiment shown is the lower inclined surface defined by the tapered surface of the inclined holder pin bores 234.

The support block 202 has a seating shoulder region 238. The support block 202 defines inclined block pin bores 240 having a center axis "H" which intersects the center axis "I" of the main bore 204 of the support block 202. The inclined block pin bores 240 in this embodiment are threaded. In order to provide working clearance for the pins 210, and as shown in FIG. 6, the axes "H" of the two block pin bores 240 intersect at an angle, in this example at 90° relative to each other. Of course, the axes of the two block pin bores 240 could intersect at any given angle, and in actuality, need not intersect at all, nor intersect the center axis "I."

The pins 210 have a structure identical to the pins 16 described with regard to the embodiments shown in FIGS. 1 and 2. Accordingly, the pins 210 have a pin engagement surface 242 which are tapered to provide an inclined surface to engage the holder engagement surface 236 of the holder engagement recess, i.e., the inclined holder pin bores 234 shown in this embodiment. Similar to the embodiments shown in FIGS. 1 and 2, the pins 210 are inserted into the inclined block pin bores 240 after being roughly aligned with the inclined holder pin bores 234. At this point, there will preferably be a small gap between the holder shoulder 216 and the seating shoulder region 238 of the support block 202.

The pins 210 are then threadably moved such that the pin engagement surface 242 will engage the holder engagement surface 236 of the cutting tool holder 206. Because at least one, in this case both, of the holder engagement surface 236 and the pin engagement surface 242 defines an inclined surface, the tapered portion 232 of the holder shank portion 208 of the cutting tool holder 206 will be wedged downward into a tight fitting relationship with the main bore 204 of the support block 202 until the holder shoulder 216 abuts the seating shoulder region 238 of the support block 202 as shown in FIG. 5. In order to accomplish this result, it is preferred that the holder engagement surfaces 236 and the pin engagement surfaces 242 have a maximum total included angle of approximately 16°. Not only will this result in a tight fit similar to the embodiments shown in FIGS. 1 and 2, but because the pins 210 are inclined along the axes "H" some of the load carried by the pins 208 will be distributed axially along the pins 208, resulting in a stronger connection overall.

While any angle could be utilized, it is preferred that the pins 208 be set at an angle of approximately 70° to 90° relative to the axis "I" of the main bore 204 of the support block 202. As shown in FIG. 5, it is also preferred that the pins 208 be inclined downwardly from the surface of the support block 202 to the axis "I" of the tool holder 214. While the axes "H" of the pins 210 and the block pin bores 240 preferably intersect at the center axis "I" of the main bore 204, many other arrangements are possible and included in the scope of this invention. Furthermore, while two pins 210 are shown as being used, one or more pins may be used.

All patents and patent applications cited herein are hereby incorporated by reference in their entirety.

While particular embodiments of the invention has been illustrated and described, it will be obvious to those skilled in the art that various changes and modifications may be made without departing from this invention. It is intended that the following claims cover all such modifications and all equivalents that fall within the spirit of this invention.

What is claimed is:

1. An excavation cutting tool holder retention system comprising:

a cutting tool holder having a holder engagement surface;

a support block having a tool holder bore into which the cutting tool holder is inserted; and a pin having a pin engagement surface, the pin being movably mounted to the support block such that the pin engagement surface may be moved to engage the holder engagement surface, at least one of the holder and pin engagement surfaces defining an inclined surface such that when the pin engagement surface is moved to engage the holder engagement surface the cutting tool holder will be drawn into the tool holder bore, and wherein the support block has a seating shoulder region and the cutting tool holder has a holder shoulder such that the seating shoulder region will abut the holder shoulder when the cutting tool holder is drawn into the tool holder bore.

2. The excavation cutting tool holder retention system of claim 1 wherein the pin is threadably mounted to the support block such that the pin engagement surface may be threadably moved to engage the holder engagement surface.

3. The excavation cutting tool holder retention system of claim 1 wherein at least one of the holder and pin engagement surfaces has a generally conical shape.

4. The excavation cutting tool holder retention system of claim 1 wherein at least one of the cutting tool holder and tool holder bore is tapered such that the cutting tool holder will be wedged into the tool holder bore of the support block when the pin engagement surface is moved to engage the holder engagement surface so as to draw the cutting tool holder into the tool holder bore.

5. An excavation cutting tool holder retention system comprising:

a cutting tool holder having a holder engagement surface and a shank portion;

a support block having a tool holder bore into which the shank portion of the cutting tool holder is inserted; and a pin having a pin engagement surface, the pin being movably mounted to the support block such that the pin engagement surface may be moved to engage the holder engagement surface, at least one of the holder and pin engagement surfaces defining an inclined surface, and at least one of the shank portion and tool holder bore being tapered, such that when the pin engagement surface is moved to engage the holder engagement surface, the shank portion of the cutting tool holder will be drawn and wedged into the tool holder bore of the support block, and wherein the support block has a seating shoulder region and the cutting tool holder has a holder shoulder such that the seating shoulder region will abut the holder shoulder when the shank portion of the cutting tool holder is drawn into the tool holder bore.

6. The excavation cutting tool holder retention system of claim 5 wherein the pin is threadably mounted to the support block such that the pin engagement surface may be threadably moved to engage the holder engagement surface.

7. The excavation cutting tool holder retention system of claim 5 wherein at least one of the holder and pin engagement surfaces has a generally conical shape.

8. An excavation cutting tool holder retention system comprising:

a cutting tool holder having a shank portion, the shank portion having a holder engagement surface;

a support block having a tool holder bore into which the shank portion of the cutting tool holder is inserted; and a pin having a pin engagement surface, the pin being movably mounted to the support block such that the pin engagement surface may be moved to engage the holder engagement surface, at least one of the holder and pin engagement surfaces defining an inclined surface such that when the pin engagement surface is moved to engage the holder engagement surface the shank portion of the cutting tool holder will be drawn into the tool holder bore, and wherein the support block has a seating shoulder region and the cutting tool holder has a holder shoulder such that the seating shoulder region will abut the holder shoulder when the shank portion of the cutting tool holder is drawn into the tool holder bore.

9. The excavation cutting tool holder retention system of claim 8 wherein the pin is threadably mounted to the support block such that the pin engagement surface may be threadably moved to engage the holder engagement surface.

10. The excavation cutting tool holder retention system of claim 8 wherein at least one of the holder and pin engagement surfaces has a generally conical shape.

11. The excavation cutting tool holder retention system of claim 8 wherein at least one of the shank portion and tool holder bore is tapered such that the shank portion of the cutting tool holder will be wedged into the tool holder bore of the support block when the pin engagement surface is moved to engage the holder engagement surface so as to draw the shank portion of the cutting tool holder into the tool holder bore.

12. The excavation cutting tool holder retention system of claim 11 wherein the pin is threadably mounted to the support block such that the pin engagement surface may be threadably moved to engage the holder engagement surface.

13. The excavation cutting tool holder retention system of claim 11 wherein at least one of the holder and pin engagement surfaces has a generally conical shape.

14. An excavation cutting tool holder retention system comprising:

a cutting tool holder having a shank portion, the shank portion having a holder engagement recess, the holder engagement recess having a holder engagement surface;

a support block having a threaded block pin bore and a tool holder bore into which the shank portion of the cutting tool holder is inserted; and a pin having a threaded engagement portion and a pin engagement surface, the threaded engagement portion of the pin threadably engaging the threaded block pin bore such that the pin engagement surface may be threadably moved to engage the holder engagement surface, at least one of the holder and pin engagement surfaces defining an inclined surface, and at least one of the shank portion and tool holder bore being tapered, such that when the pin engagement surface is moved to engage the holder engagement surface, the shank portion of the cutting tool holder will be drawn and wedged into the tool holder bore, and wherein the support block has a seating shoulder region and the cutting tool holder has a holder shoulder such that the seating shoulder region will abut the holder shoulder when the shank portion of the cutting tool holder is drawn into the tool holder bore.

15. The excavation cutting tool holder retention system of claim 14 wherein at least one of the holder engagement recess and pin engagement surface has a generally conical shape.

16. The excavation cutting tool holder retention system of claim 14 wherein the shank portion of the cutting tool holder has a shank axis and the threaded block pin bore of the support block has a pin bore axis and the shank axis intersects the pin bore axis in a perpendicular relationship.

17. The excavation cutting tool holder retention system of claim 14 wherein the shank portion of the cutting tool holder has a shank axis and the threaded block pin bore of the support block has a pin bore axis and the shank axis intersects the pin bore axis at an acute angle.

18. The excavation cutting tool holder retention system of claim 14 wherein the tool holder bore of the support block has a tool holder bore axis, a first pin has a first pin axis and a second pin has a second pin axis, and the first pin axis and the second pin axis are aligned and intersect the tool holder bore axis.

19. The excavation cutting tool holder retention system of claim 14 wherein the tool holder bore of the support block has a tool holder bore axis, a first pin has a first pin axis and a second pin has a second pin axis, the first pin axis and the second pin axis intersect at an acute angle, and both the first pin axis and the second pin axis intersect the tool holder bore axis.

20. An excavation cutting tool holder for use with a support block having a tool holder bore into which the cutting tool holder is inserted and a pin having a pin engagement surface, the pin being movably mounted to the support block, the cutting tool holder comprising:

an outer wear region and a shank portion, the shank portion having a holder engagement surface which engages the pin engagement surface, the holder engagement surface defining an inclined surface such that when the pin engagement surface is moved to engage the holder engagement surface the shank portion will be drawn into the tool holder bore of the support block, and wherein the outer wear region defines a holder shoulder that abuts the support block when the shank portion is drawn into the tool holder bore of the support block.

21. The excavation cutting tool holder of claim 20 wherein the holder engagement surface has a generally conical shape.

22. The excavation cutting tool holder of claim 20 wherein the shank portion is tapered such that the shank portion will be wedged into the tool holder bore of the support block when the pin engagement surface is moved to engage the holder engagement surface so as to draw the shank portion into the tool holder bore of the support block.

23. An excavation cutting tool holder retention system comprising:

a cutting tool holder having a shank portion, the shank portion having a holder engagement recess, the holder engagement recess having a holder engagement surface;

a support block having a threaded block pin bore and a tool holder bore into which the shank portion of the cutting tool holder is inserted; and a pin having a threaded engagement portion and a pin engagement surface, the threaded engagement portion of the pin threadably engaging the threaded block pin bore such that the pin engagement surface may be threadably moved to engage the holder engagement surface, at least one of the holder and pin engagement surfaces defining an inclined surface, and at least one of the shank portion and tool holder bore being tapered, such that when the pin engagement surface is moved to engage the holder engagement surface, the shank portion of the cutting tool holder will be drawn and wedged into the tool holder bore, and wherein at least one of the holder engagement recess and pin engagement surface has a generally conical shape.

24. An excavation cutting tool holder retention system comprising:

a cutting tool holder having a shank portion, the shank portion having a holder engagement recess, the holder engagement recess having a holder engagement surface;

a support block having a threaded block pin bore and a tool holder bore into which the shank portion of the cutting tool holder is inserted; and a pin having a threaded engagement portion and a pin engagement surface, the threaded engagement portion of the pin threadably engaging the threaded block pin bore such that the pin engagement surface may be threadably moved to engage in the holder engagement surface, at least one of the holder and pin engagement surfaces defining an inclined surface, and at least one of the shank portion and tool holder bore being tapered, such that when the pin engagement surface is moved to engage the holder engagement surface, the shank portion of the cutting tool holder will be drawn and wedged into the tool holder bore, and wherein the shank portion of the cutting tool holder has a shank axis and the threaded block pin bore of the support block has a pin bore axis and the shank axis intersects the pin bore axis in a perpendicular relationship.

25. An excavation cutting tool holder retention system comprising:

a cutting tool holder having a shank portion, the shank portion having a holder engagement recess, the holder engagement recess having a holder engagement surface;

a support block having a threaded block pin bore and a tool holder bore into which the shank portion of the cutting tool holder is inserted; and a pin having a threaded engagement portion and a pin engagement surface, the threaded engagement portion of the pin threadably engaging the threaded block pin bore such that the pin engagement surface may be threadably moved to engage the holder engagement surface, at least one of the holder and pin engagement surfaces defining an inclined surface, and at least one of the shank portion and tool holder bore being tapered, such that when the pin engagement surface is moved to engage the holder engagement surface, the shank portion of the cutting tool holder will be drawn and wedged into the tool holder bore, and wherein the tool holder bore of the support block has a tool holder bore axis, a first pin has a first pin axis and a second pin has a second pin axis, and the first pin axis and the second pin axis are aligned and intersect the tool holder bore axis.

26. An excavation cutting tool holder retention system comprising:

a cutting tool holder having a shank portion, the shank portion having a holder engagement recess, the holder engagement recess having a holder engagement surface;

a support block having a threaded block pin bore and a tool holder bore into which the shank portion of the cutting tool holder is inserted; and a pin having a threaded engagement portion and a pin engagement surface, the threaded engagement portion of the pin threadably engaging the threaded block pin bore such that the pin engagement surface may be threadably moved to engage the holder engagement surface, at least one of the holder and pin engagement surfaces defining an inclined surface, and at least one of the shank portion and tool holder bore being tapered, such that when the pin engagement surface is moved to engage the holder engagement surface, the shank portion of the cutting tool holder will be drawn and wedged into the tool holder bore, and wherein the tool holder bore of the support block has a tool holder bore axis, a first pin has a first pin axis and a second pin has a second pin axis, the first pin axis and the second pin axis intersect at an acute angle, and both the first pin axis and the second pin axis intersect the tool holder bore axis.

* * * * *